US010283097B2

(12) United States Patent
Shi et al.

(10) Patent No.: US 10,283,097 B2
(45) Date of Patent: May 7, 2019

(54) INTERACTIVE SYSTEM AND METHOD FOR CREATING MUSIC BY SUBSTITUTING AUDIO TRACKS

(71) Applicants: Zheng Shi, Beijing (CN); Zhengzheng Pan, Beijing (CN); Xin Wang, Beijing (CN)

(72) Inventors: Zheng Shi, Beijing (CN); Zhengzheng Pan, Beijing (CN); Xin Wang, Beijing (CN)

( * ) Notice: Subject to any disclaimer, the term of this patent is extended or adjusted under 35 U.S.C. 154(b) by 0 days.

(21) Appl. No.: 15/964,052

(22) Filed: Apr. 26, 2018

(65) Prior Publication Data

US 2018/0247625 A1 Aug. 30, 2018

Related U.S. Application Data

(63) Continuation-in-part of application No. PCT/CN2016/103859, filed on Oct. 29, 2016.

(30) Foreign Application Priority Data

Oct. 29, 2015 (CN) ..... 2015 1 07258150

(51) Int. Cl.
*G10H 1/36* (2006.01)
*G10H 1/00* (2006.01)
(Continued)

(52) U.S. Cl.
CPC ..... *G10H 1/0025* (2013.01); *G10H 1/38* (2013.01); *G10H 1/40* (2013.01);
(Continued)

(58) Field of Classification Search
CPC ..... G10H 1/0025; G10H 2210/066; G10H 2210/076; G10H 2240/145;
(Continued)

(56) References Cited

U.S. PATENT DOCUMENTS 6,140,568 A * 10/2000 Kohler ..... G10H 1/0066 84/616
7,847,178 B2 * 12/2010 Georges ..... G10H 1/0025 84/603
(Continued)

FOREIGN PATENT DOCUMENTS

CN 01020002 6/2008
CN 102037486 4/2011

OTHER PUBLICATIONS

SIPO: International Search Report for PCT Application No. PCT/CN2016/103859 filed Oct. 29, 2016, dated Jan. 20, 2017.

*Primary Examiner* — Marlon T Fletcher

(57) ABSTRACT

In order to help music players without sufficient musical knowledge to adapt original music pieces but still keep the original style, the present invention provides an interactive system and the accompanying method for creating music by substituting audio tracks. The interactive system includes a database of musical elements that comprises tonality, tempo, beat, timbre, texture, chord, and pitch, a database of music that contains multiple original music pieces, and a processor. As a result, players without strong knowledge in music theories can create adapted a music piece that matches the style of the original one.

16 Claims, 2 Drawing Sheets

(51) Int. Cl.
*G10H 1/38* (2006.01)
*G10H 1/40* (2006.01)

(52) U.S. Cl.
CPC . *G10H 2210/005* (2013.01); *G10H 2210/066* (2013.01); *G10H 2210/071* (2013.01); *G10H 2210/076* (2013.01); *G10H 2210/125* (2013.01); *G10H 2240/131* (2013.01)

(58) Field of Classification Search
CPC ..... G10H 2210/056; G10H 2240/131; G10H 2240/135; G10H 1/08; G06F 3/165; G06F 17/30778
See application file for complete search history.

(56) References Cited

U.S. PATENT DOCUMENTS

| | | | | |
|---|---|---|---|---|
| 8,273,976 | B1 | 9/2012 | Dalby | |
| 2009/0234475 | A1 | 9/2009 | Lagadec et al. | |
| 2012/0093343 | A1* | 4/2012 | Batchelder | G11B 27/034 381/119 |
| 2012/0297958 | A1* | 11/2012 | Rassool | G06F 3/0481 84/609 |
| 2014/0180674 | A1* | 6/2014 | Neuhauser | G10L 25/81 704/9 |
| 2017/0330540 | A1* | 11/2017 | Quattro | G10H 1/0008 |
| 2018/0005614 | A1* | 1/2018 | Vilermo | G10H 1/46 |
| 2018/0247625 | A1* | 8/2018 | Shi | G10H 1/0025 |
| 2018/0315452 | A1* | 11/2018 | Shi | G11B 27/007 |

* cited by examiner

INTERACTIVE SYSTEM AND METHOD FOR CREATING MUSIC BY SUBSTITUTING AUDIO TRACKS

CROSS-REFERENCE TO RELATED APPLICATION

This application is a continuation in part of International Patent Application No. PCT/CN2016/103859, entitled "Interactive System and Method for Creating Music by Substituting Audio Tracks", filed on Oct. 29, 2016, which claims priority of Patent Application CN2015107258150, entitled "A Musical Instrument for Substituting Audio Tracks", filed on Oct. 29, 2015. The entire disclosure of the above application is incorporated herein by reference.

TECHNICAL FIELD

The present invention relates to an interactive system and method for creating music by substituting audio tracks, which enable players without strong knowledge of music theories to not only adapt an original music piece, but also inherit the style of the original music piece to make it a part of the new music piece.

BACKGROUND

Original music pieces are always played and adapted, especially for those master pieces loved by music fans all over the world. However, for music players who don't know much about music theories, the threshold of adaptation is so high that, even if they are full of inspiration, they do not know how to start, since they cannot effectively use musical elements such as tonality, tempo, beat, timbre, texture, pitch, not to mention manipulating audio tracks. As a result, their inspiration might be wasted. In fact, all of these music elements can be represented by data packets in the modern digital music industry, typically in the format of MIDI files. And both data packets and MIDI files can be coded, so as to be selected, called, recommended, and presented by music players and or CPUs of musical instrument systems. As long as the above-mentioned technology is applied to a musical instrument, players will only need to focus on the derivative work without worrying about those musical elements.

SUMMARY OF THE INVENTION

Aiming to solve the problems above, the present invention provides an interactive system and the accompanying method for creating music by substituting audio tracks.

In accordance with one embodiment of the present invention, the interactive system includes a database of musical elements that comprises tonality, tempo, beat, timbre, texture, chord, and pitch, a database of music that contains multiple original music pieces, and a processor. The workflow of the interactive system is as follows:

the first part: the interactive system selects an original music piece from the database of music, splits the original music piece into a number of audio tracks, and extracts multiple musical elements from the original music piece;

the second part: the interactive system sets up one or more of the musical elements;

the third part: the interactive system synthesizes an accompaniment with one or more of the audio tracks, to be played as the background sound;

the fourth part: the interactive system recommends one or more of the musical elements, in accordance with predetermined rules, to a player;

the fifth part: the fourth part is repeated for one or more times till the formation of a new audio track, and the interactive system combines the new audio track with the audio tracks used in the third part to create a new music piece that matches the original music piece.

In accordance with one embodiment of the present invention, the first part further includes:

the interactive system starts;

the interactive system selects the original music piece from the database of music;

the interactive system splits the original music into multiple audio tracks, and extracts the tonality, the tempo and the beat mutually used in the audio tracks, and simultaneously, extracts a predetermined number of the most frequently used pitches from the audio tracks to forms a database of pitches.

In accordance with one embodiment of the present invention, the second part further includes: the interactive system combines a timbre with the tonality, the tempo and the beat mutually used in the audio tracks to generate a texture, and the timbre is either selected by the player or determined by the interactive system. Optionally, the second part further includes: the interactive system combines a timbre of a percussion instrument selected by the player with the tempo and the beat mutually used in the audio tracks to synthesize a percussion music piece, to be played as the background sound.

In accordance with one embodiment of the present invention, with the second part proceeding, the third part further includes: the interactive system combines all audio tracks other than a melody audio track to synthesize the accompaniment, to be played as the background sound.

In accordance with one embodiment of the present invention, the fourth part further includes:

with the determined texture, the interactive system extracts multiple pitches from the database of pitches to form a pitch group, and recommends for the player to select either none or one or more than one pitches from the pitch group during a time period of playing;

the interactive system repeats the extracting and recommending process for one or more times during each of the following time periods, till the end of playing. The duration of each time period is all the same, and is an integral multiple of each beat. And the period for recommending is equal to the duration of a single time period or an integral multiple of a time period of playing.

In accordance with one embodiment of the present invention, the fifth part further includes: the interactive system combines the new audio track with all audio tracks other than the melody audio track to synthesize the new music piece that matches the original music piece. Optionally, the interactive system records the new music piece and generates a file that can be played back for multiple times.

In brief, the core of the present invention is to, after the original music piece has been split into multiple audio tracks, replace one of the audio tracks with a new audio track (such as a new melody) created by players. The system recommends a group of pitches that have been selected by the processor to players for each bar or each a few bars during playing, through flashing buttons/keys or touch screens of the system. And thus, players will get visible hints for pitches in each bar or each a few bars during their playing, so as to make selections and then play pitch streams (i.e., the new melody) in harmony with other existing original audio tracks, which means that players without strong knowledge in music theories would be able to complete music adaptation relatively easily. Since the new audio track and the other existing original audio tracks share the same or similar tempo, beat and mode, the new melody created by merging these audio tracks will not only keep the style of the original music work, but also introduce harmonious and fresh elements.

BRIEF DESCRIPTION OF THE DRAWINGS

To better illustrate the technical features of the embodiments of the present invention, various embodiments of the present invention will be briefly described in conjunction with the accompanying drawings. It should be obvious that the drawings are only for exemplary embodiments of the present invention, and that a person of ordinary skill in the art may derive additional drawings without deviating from the principles of the present invention.

DETAILED DESCRIPTION OF THE INVENTION

To better illustrate the purpose, technical feature, and advantages of the embodiments of the present invention, various embodiments of the present invention will be further described in conjunction with the accompanying drawings.

While the present invention will be described in connection with various specific embodiments, the invention is not limited to these embodiments. People skilled in the art will recognize that the system and method of the present invention may be used in many other applications. The present invention is intended to cover all alternatives, modifications and equivalents within the spirit and scope of invention, which is defined by the apprehended claims.

The technical scheme in the embodiments of the present invention will be described clearly and completely by reference to the accompanying drawings.

Figure 1:
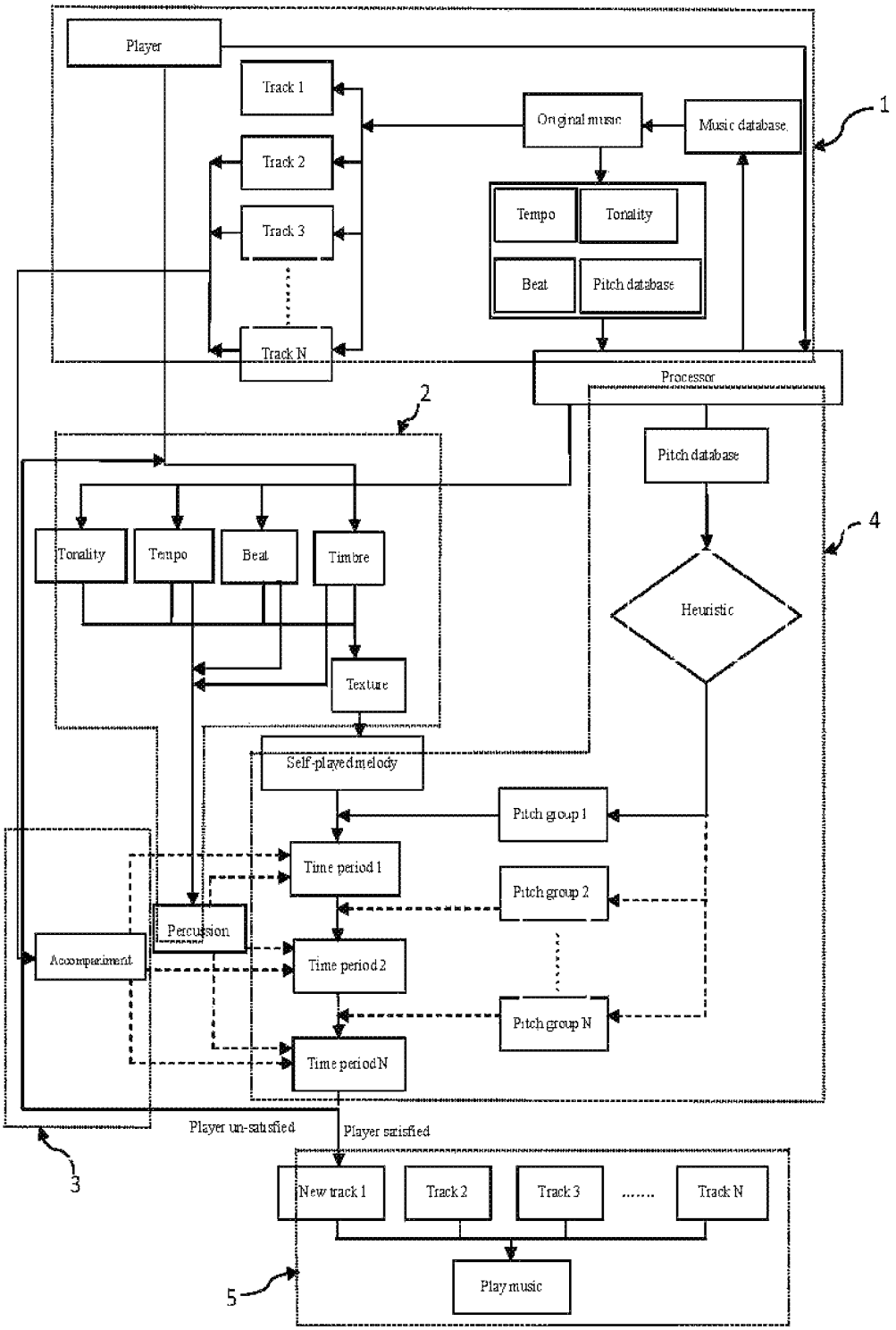
FIG. 1 is a schematic diagram illustrating the process flow of the interactive system in accordance with one embodiment of the present invention.

The present invention introduces an interactive system for creating music by substituting audio tracks, which will now be illustrated in detail with a keyboard musical instrument as an example, as shown in FIG. 1. The interactive system includes a database of musical elements, which contains musical elements such as tonality, tempo, beat, timbre, texture, and pitch. These musical elements can be pre-stored in the form of MIDI files in media such as chips of the interactive system. The system further includes a database of music that contains multiple original music pieces, and a processor.

The workflow of the interactive system is as follows:

the first part: the interactive system selects an original music piece from the database of music, splits the original music piece into a number of audio tracks, and extracts multiple musical elements from the original music piece, as shown in the dotted box 1 in FIG. 1;

the second part: the interactive system sets up one or more of the musical elements, as shown in the dotted box 2 in FIG. 1;

the third part: the interactive system synthesizes an accompaniment with one or more of the audio tracks, to be played as the background sound, as shown in the dotted box 3 in FIG. 1;

the fourth part: the interactive system recommends one or more of the musical elements, in accordance with predetermined rules, to a player, as shown in the dotted box 4 in FIG. 1;

the fifth part: the fourth part is repeated for one or more times till the formation of a new audio track, and the interactive system combines the new audio track with the audio tracks used in the third part to create a new music piece that matches the original music piece, as shown in the dotted box 5 in FIG. 1.

In FIG. 1, the apostrophes between the multiple "audio tracks" represent an unspecified number of audio tracks. Likewise, the apostrophes between the multiple "pitch groups" represent an unspecified number of pitch groups.

In FIG. 1, multiple dashed arrows are used for "pitch groups" other than "pitch group 1" to mean that the recommending process similar to that for pitch group 1 could be repeatedly applied to any other pitch group within the interactive system.

In FIG. 1, multiple dashed arrows are used for "percussion" to mean that the percussion music could be played as background sound within any time period during players' playing.

In FIG. 1, multiple dashed arrows are used for "accompaniment" to mean that the existing original audio tracks that have not been substituted or the collection of these audio tracks could be played as background sound within any time period during players' playing.

The first part could further consist of the following steps, as shown in FIG. 1:

Step 1: the interactive system starts.

Step 2: the interactive system selects the original music piece from the database of music.

Step 3: the interactive system splits the original music into multiple audio tracks, e.g. (for a piano piece), audio track one (piano, i.e., the melody audio track), audio track two (violin), audio track three (viola), audio track four (saxophone), . . . , audio track N (harp), and extracts the tonality, the tempo and the beat mutually used in these audio tracks, e.g., C major, two beats per second, 2/4 beat (two quarter-note beats per bar). Meanwhile, the interactive system extracts a predetermined number of the most frequently used pitches from the audio tracks, e.g., the six pitches, 1, 3, 4, 5, 7, #1, to form a database of pitches for further use.

The second part could further consist of the following step, as shown in FIG. 1:

Step 4: the interactive system combines a timbre selected by a player, e.g., clarinet, with the musical elements such as C major, two beats per second, 2/4 beat that have been extracted in step 3 to generate the texture. If no timbre is selected by the player, the interactive system will recommend a timbre by default, e.g., piano. Optionally, the interactive system may combine a timbre of a percussion instrument, e.g., gong, with the tempo and the beat that have been mutually used in the audio tracks to synthesize a percussion music piece, which is played as the background sound during any time period for music playing.

While the second part proceeds, optionally, the third part can also be executed separately, as shown in FIG. 1:

After the original music piece has been split, the interactive system combines all audio tracks excluding the melody audio track (audio track one), i.e., audio track two, audio track three, . . . , audio track N, to synthesize the accompaniment, which is played as the background sound during any time period for music playing.

The fourth part could further consist of the following steps, as shown in FIG. 1:

Step 5: after the texture has been determined, the interactive system selects three pitches from the database of pitches comprising six pitches in total to form a pitch group, and recommends it to the player. The player may select one or two or three pitches from the pitch group during any time period of playing, e.g., a bar. If no selection is made, the player may also play any pitches he/she would like to.

Step 6: during the next time period of playing, e.g., the next bar, the interactive system once again selects three pitches from the database of pitches to form a new pitch group, and recommends it to the player. Once again, the player may choose either none or one or more than one pitches from the pitch group during this time period.

Step 5 and step 6 can be repeated for multiple times during each of the following time periods, till the pitch group N is recommended.

And it should be noted that the duration of each time period of playing is identical. Specifically, the duration should be an integral multiple of each beat. Preferably, the multiple is an even number, such as 2, 4, 6, etc. And the period for the pitch recommendation is equal to the duration of a single time period or an integral multiple of a time period of playing, e.g., one pitch recommendation per every one beat, every two beats, every four beats, every bar, every two bars, every four bars, every six bars, etc.

The fifth part could further consist of the following step, as shown in FIG. 1:

Step 7: with step 5 and step 6 repeated for multiple times, the player is finally satisfied with the derivative work and thus the music adaptation is completed. The new audio track is now created, and is combined with the existing original audio track two, audio track three, . . . , audio track N to synthesize the new music piece that is definitely different from the original music piece but matches the original one well from the perspective of music theories. Optionally, the interactive system records this new music piece, i.e., the melody that has been played throughout all time periods, and generates an MIDI file that can be played back for multiple times.

The pitches recommended by the system and selected by the player are all codes for data packets pre-stored in the system, which can be interpreted by the key values sent to the processor from the multiple keys of the interactive system.

The rules for the pitch recommendation to players by the processor of the interactive system, namely heuristic, are shown inside the diamond box in the right hand side in FIG. 1. The two core rules are summarized as follows.

Rule 1, the extraction rule as shown in the dotted box 1 in FIG. 1:

Only a predetermined number of the most frequently used pitches (specifically, the pitches in the same mode commonly shared in all audio tracks of the original music piece) can be extracted from the multiple audio tracks of the original music piece. For example, the six most frequently used pitches (out of the totally twelve pitches) in the original music piece are extracted to establish a database of pitches for further use. The concept means that whichever of the six pitches are used in the melody of the adapted music piece, the new piece always sounds harmonious from the perspective of music theories.

Rule 2, the recommendation rule as shown in the diamond box 1 for "heuristic" in FIG. 1:

The recommendation is based on the frequency/period of time periods, and the frequency/period is determined by the tempo and the beat mutually used in the multiple audio tracks of the original music piece.

The texture is formed by the player based on the tonality, the tempo and the beat mutually used in audio track two, audio track three, . . . , audio track N, and then the pitches recommended by the system are also adopted by the player. As a result, the new music piece is consistent with the original one in terms of both pitches and the rhythm.

The detail regarding how hints are provided to players when the system recommends pitches is described as follows.

Figure 2:
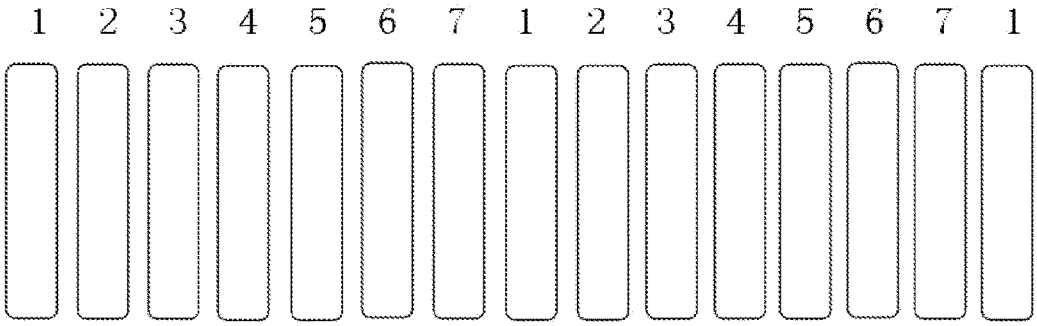
FIG. 2 is an exemplary schematic diagram illustrating the corresponding relationship between pitches and flashing keys for hints in accordance with one embodiment of the present invention.

As shown in FIG. 2, the Arabic numerals in FIG. 2 represent the multiple pitch keys on the keyboard of the musical instrument. During a time period of playing (e.g., a bar), once one or more of the pitch keys are flashing, it indicates that the system is recommending these pitches to the player for the next time period (e.g., the next bar). For example, once a bar is to be completed during the playing time of the player, the system instructs the three pitch keys printed with Arabic numerals 2, 5 and 7 on the keyboard of the musical instrument to flash. When the player notices the flashing keys on the keyboard, she/he can select one or more pitches by pressing these pitch keys before the next bar starts.

Players can also substitute or merge the other audio tracks of the original music piece to get different looks of new music pieces.

The musical elements such as tonality, tempo, beat, timbre, texture, and pitch can all be in the format of MIDI files, pre-stored in the system and available to be called or recommended at any time. Apparently, all of these musical elements in the present invention as well as the relationships between and among them can be assigned values in computer programming.

The invention claimed is:

1. An interactive system for creating music, comprising:

a database comprising musical elements selected from tonality, tempo, beat, timbre, texture, and pitch;

a database of music comprising a plurality of original music pieces;

a processor;

wherein the workflow of the interactive system is:

the first part, the interactive system selects an original music piece from the database of music, splits the original music piece into a plurality of audio tracks, and extracts a plurality of musical elements;

the second part, the interactive system sets up one or more among the plurality of musical elements;

the third part, the interactive system synthesizes an accompaniment with one or more among the plurality of audio tracks, to be played as the background sound;

the fourth part, the interactive system recommends one or more among the plurality of musical elements, in accordance with predetermined rules, to a player;

the fifth part, the fourth part is repeated for one or more times till the formation of a new audio track, and the interactive system combines the new audio track with the audio tracks used in the third part to create a new music piece that matches the original music piece.

2. The system of claim 1, wherein the first part further comprises the interactive system starts;

the interactive system selects the original music piece from the database of music;

the interactive system splits the original music into a plurality of audio tracks, and extracts the tonality, the tempo and the beat mutually used in the audio tracks, and simultaneously, extracts a predetermined number of the most frequently used pitches from the audio tracks to forms a database of pitches.

3. The system of claim 2, wherein the second part further comprises the interactive system combines a timbre with the tonality, the tempo and the beat mutually used in the audio tracks to generate a texture, and wherein the timbre is either selected by the player or determined by the interactive system.

4. The system of claim 2, wherein the second part further comprises the interactive system combines a timbre of a percussion instrument selected by the player with the tempo and the beat mutually used in the audio tracks to synthesize a percussion music piece, to be played as the background sound.

5. The system of claim 3, wherein the third part further comprises the interactive system combines all audio tracks other than a melody audio track to synthesize the accompaniment, to be played as the background sound.

6. The system of claim 5, wherein the fourth part further comprises with the determined texture, the interactive system extracts a plurality of pitches from the database of pitches to form a pitch group, and recommends for the player to select either none or one or more than one pitches from the pitch group during a time period of playing;

the interactive system repeats the extracting and recommending process for one or more times during each of the following time periods, till the end of playing;

wherein the duration of each time period is the same, and is an integral multiple of each beat;

and wherein the period for recommending is equal to the duration of a single time period or an integral multiple of a time period.

7. The system of claim 6, wherein the fifth part further comprises the interactive system combines the new audio track with all audio tracks other than the melody audio track to synthesize the new music piece that matches the original music piece.

8. The system of claim 7, wherein the interactive system records the new music piece played during all time periods, and generates a file which can be played back for multiple times.

9. An interactive method for creating music, comprising:

the first part, selecting an original music piece, splitting the original music piece into a plurality of audio tracks and extracting a plurality of musical elements, by an interactive system, wherein the interactive system comprises a database comprising musical elements selected from tonality, tempo, beat, timbre, texture, and pitch, a database of music comprising a plurality of original music pieces, and a processor;

the second part, setting up one or more among the plurality of musical elements;

the third part, synthesizing, by the interactive system, an accompaniment with one or more among the plurality of audio tracks, to be played as the background sound;

the fourth part, recommending, by the interactive system, one or more among the plurality of musical elements, in accordance with predetermined rules, to a player;

the fifth part, repeating the fourth part for one or more times till the formation of a new audio track, and combining the new audio track with the audio tracks used in the third part to create a new music piece that matches the original music piece.

10. The method of claim 9, the first part further comprising:

starting the interactive system;

selecting the original music piece from the database of music by the interactive system;

splitting the original music into a plurality of audio tracks, and extracting the tonality, the tempo and the beat mutually used in the audio tracks, and simultaneously, extracting a predetermined number of the most frequently used pitches from the audio tracks to form a database of pitches, by the interactive system.

11. The method of claim 10, the second part further comprising:

combining a timbre selected by the player with the tonality, the tempo and the beat mutually used in the audio tracks to generate a texture, by the interactive system, wherein the timbre is either selected by the player or determined by the interactive system.

12. The method of claim 10, the second part further comprising:

combining a timbre of a percussion instrument selected by the player with the tempo and the beat mutually used in the audio tracks to synthesize a percussion music piece, to be played as the background sound, by the interactive system.

13. The method of claim 11, while the second part proceeds, the third part further comprising:

combining all audio tracks other than a melody audio track to synthesize the accompaniment, to be played as the background sound, by the interactive system.

14. The interactive method of claim 13, the fourth part further comprising:

with the determined texture, extracting a plurality of pitches from the database of pitches to form a pitch group, and recommending for the player to select either none or one or more than one pitches from the pitch group during a time period of playing, by the interactive system;

repeating the extracting and recommending process for one or more times during each of the following time periods, till the end of playing;

wherein the duration of each time period is the same, and is an integral multiple of each beat;

and wherein the period for recommending is equal to the duration of a single time period or an integral multiple of a time period.

15. The interactive method of claim 14, the fifth part further comprising:

combining the new audio track with all audio tracks other than the melody audio track to synthesize the new music piece that matches the original music piece, by the interactive system.

16. The interactive method of claim 15, further comprising:

recording the new music piece played during all time periods, and generating a file which can be played back for multiple times, by the interactive system.

* * * * *